US012339082B1

(12) United States Patent
Oliver

(10) Patent No.: US 12,339,082 B1
(45) Date of Patent: Jun. 24, 2025

(54) SUPPRESSOR ATTACHMENT SYSTEM

(71) Applicant: Organization of Strategic Sciences, LLC, Murray, UT (US)

(72) Inventor: Russell Oliver, Draper, UT (US)

( * ) Notice: Subject to any disclaimer, the term of this patent is extended or adjusted under 35 U.S.C. 154(b) by 0 days.

(21) Appl. No.: 18/395,454

(22) Filed: Dec. 22, 2023

(51) Int. Cl.
*F41A 21/32* (2006.01)

(52) U.S. Cl.
CPC ..... *F41A 21/325* (2013.01)

(58) Field of Classification Search
CPC ..... F41A 21/325; F41A 21/32; F41A 21/30
USPC ..... 89/14.4; 181/223
See application file for complete search history.

(56) References Cited

U.S. PATENT DOCUMENTS 6,701,820 B2 * 3/2004 Fluhr ..... F41A 21/32 89/14.4
8,091,462 B2 * 1/2012 Dueck ..... F41A 21/26 42/76.01
8,333,139 B2 * 12/2012 Addis ..... F41A 21/32 89/14.05
8,499,676 B1 * 8/2013 Moore ..... F41A 21/325 89/14.4
10,386,147 B1 * 8/2019 Fan ..... F41A 21/36

FOREIGN PATENT DOCUMENTS

EP 1742008 A1 * 1/2007 ..... F16B 2/10

* cited by examiner

*Primary Examiner* — Reginald S Tillman, Jr.
(74) *Attorney, Agent, or Firm* — MORRISS O'BRYANT COMPAGNI CANNON, PLLC

(57) ABSTRACT

A disclosed attachment system for a energy suppression device may include an energy suppression device and an attachment mechanism secured to the energy suppression device. The attachment device may include a first lever and a second lever, the first lever may be rotatable with respect to the second lever such that the first lever may apply a force against the second lever when in a locked position and the force may be reduced when the first lever is moved to an unlocked position. The first lever may have a slot having a width that tappers from a first end of the slot to a second end of the slot. The slot may be configured to receive a tool to apply additional force to move the first lever from the locked position to the unlocked position.

12 Claims, 11 Drawing Sheets

SUPPRESSOR ATTACHMENT SYSTEM

CROSS-REFERENCE TO RELATED APPLICATIONS

Not applicable.

STATEMENT REGARDING FEDERALLY SPONSORED RESEARCH OR DEVELOPMENT

Not Applicable.

BACKGROUND

1. The Field of the Present Disclosure

The present disclosure relates generally to mechanisms used to reduce and/or regulate and release energy, and more particularly, but not necessarily entirely, to an secondary energy regulation and release device that may be fixed or attached to a primary suppression device on a weapon or other energy generating and expelling device.

2. Description of Related Art

Conventionally, weapon signature reduction experts have focused upon the sciences of understanding and directing the transition of energy from a muzzle of a weapon into an unrestricted atmosphere (internal to external). This energy transition, together with its traditional and well-known signatures of flash, heat, and sound, can be described as instantaneous and violent. It is this violent transfer and transition of energy that creates a readily identifiable and detrimental weapons signature. The buffering of this transition via volume, torturous geometry, turbulence, and various media among many other techniques, can substantially and positively diminish signature, including a positive buffering, reduction or diminishment of flash, heat, and sound. However, these traditional solutions themselves create secondary adverse consequences in both weapon operation (rate of fire, liability, durability, blowback exposure), and undesirable physical attributes (excessive length and weight, limiting maneuverability of a weapon system).

The conventional art or common practices are thus characterized by several disadvantages that are addressed by the present disclosure. The present disclosure minimizes, and in some aspects eliminates, the above-mentioned failures, and other problems, by utilizing the methods and structural features described herein.

The features and advantages of the present disclosure will be set forth in the description which follows, and in part will be apparent from the description, or may be learned by the practice of the present disclosure without undue experimentation. The features and advantages of the present disclosure may be realized and obtained by means of the instruments and combinations particularly pointed out in the appended claims. Any discussion of documents, acts, materials, devices, articles or the like which has been included in the present specification is not to be taken as an admission that any or all of these matters form part of the prior art base, or were common general knowledge in the field relevant to the present disclosure as it existed before the priority date of each claim of this application.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
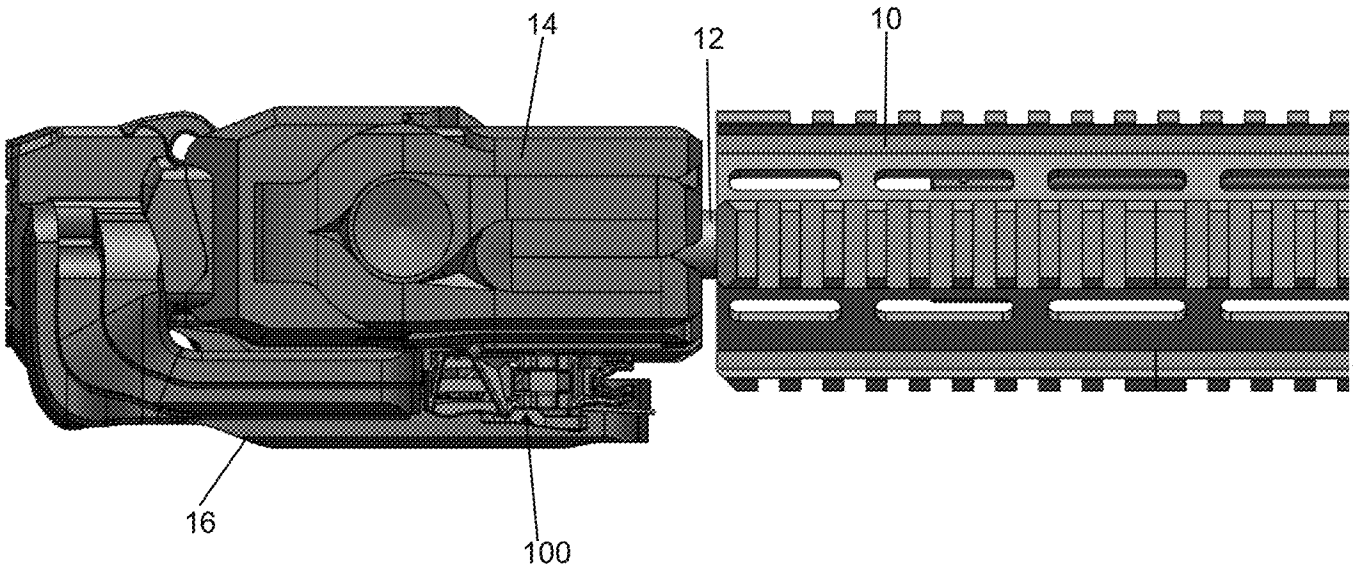
FIG. 1 is a side view of a first embodiment of the disclosed device.
Figure 2:
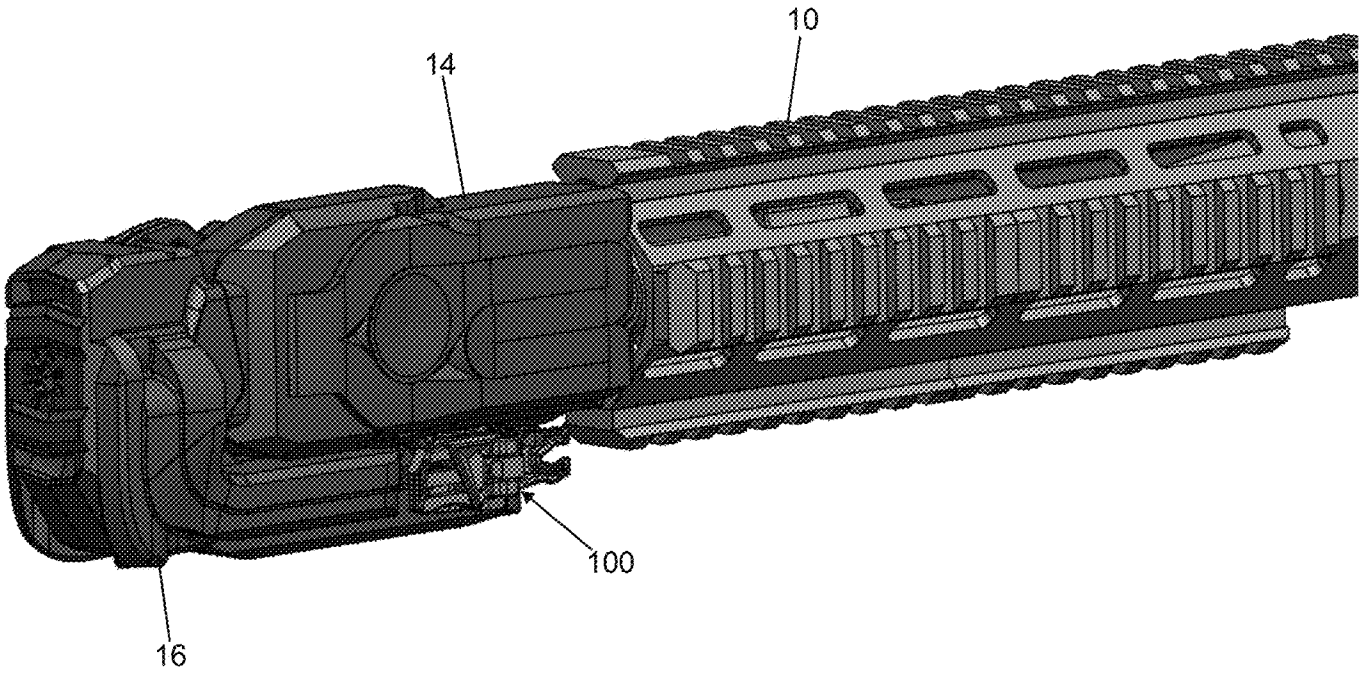
FIG. 2 is a perspective view of the first embodiment of the disclosed device.
Figure 3:
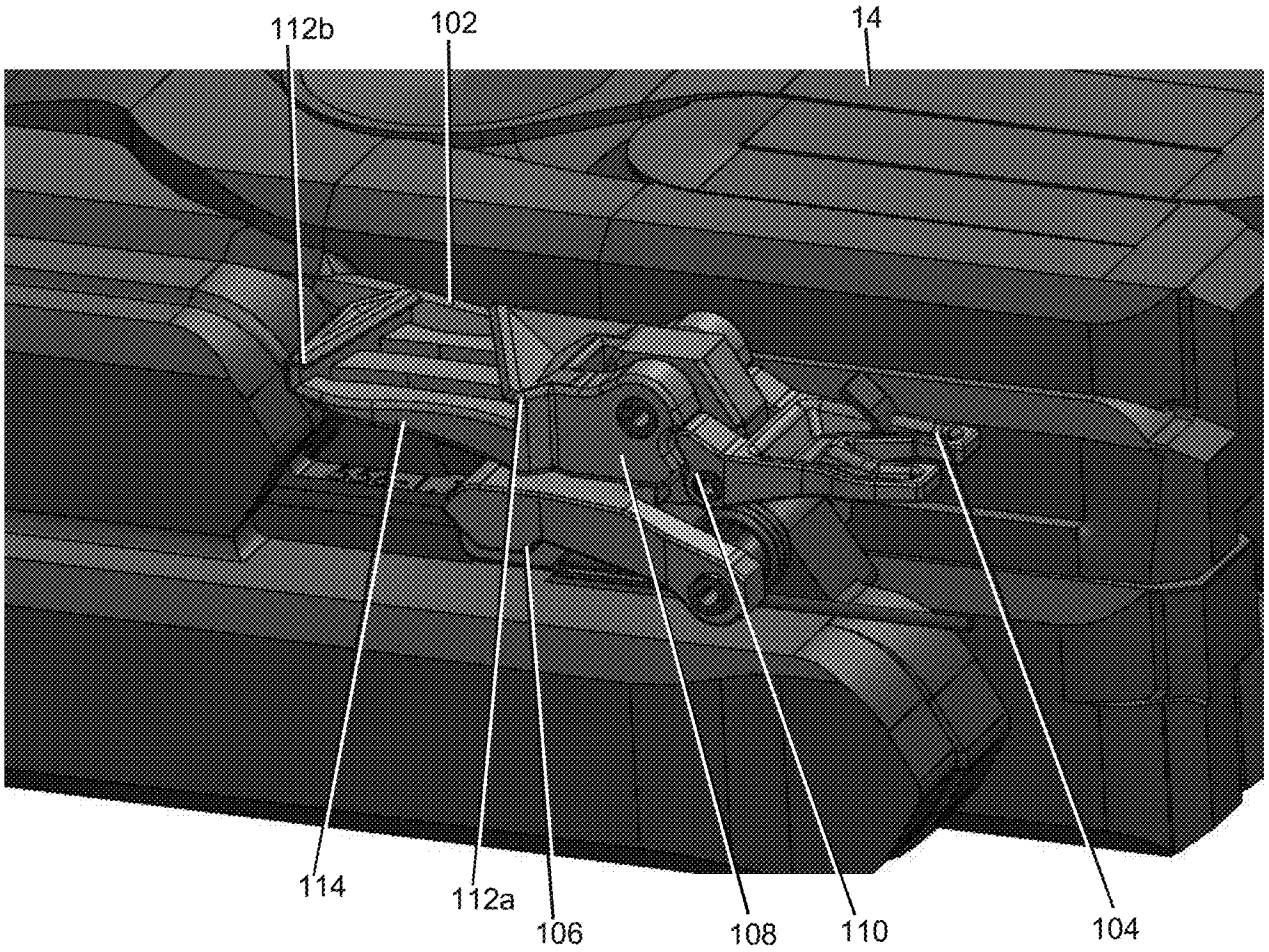
FIG. 3 is a bottom view of the first embodiment of the disclosed device.
Figure 4:
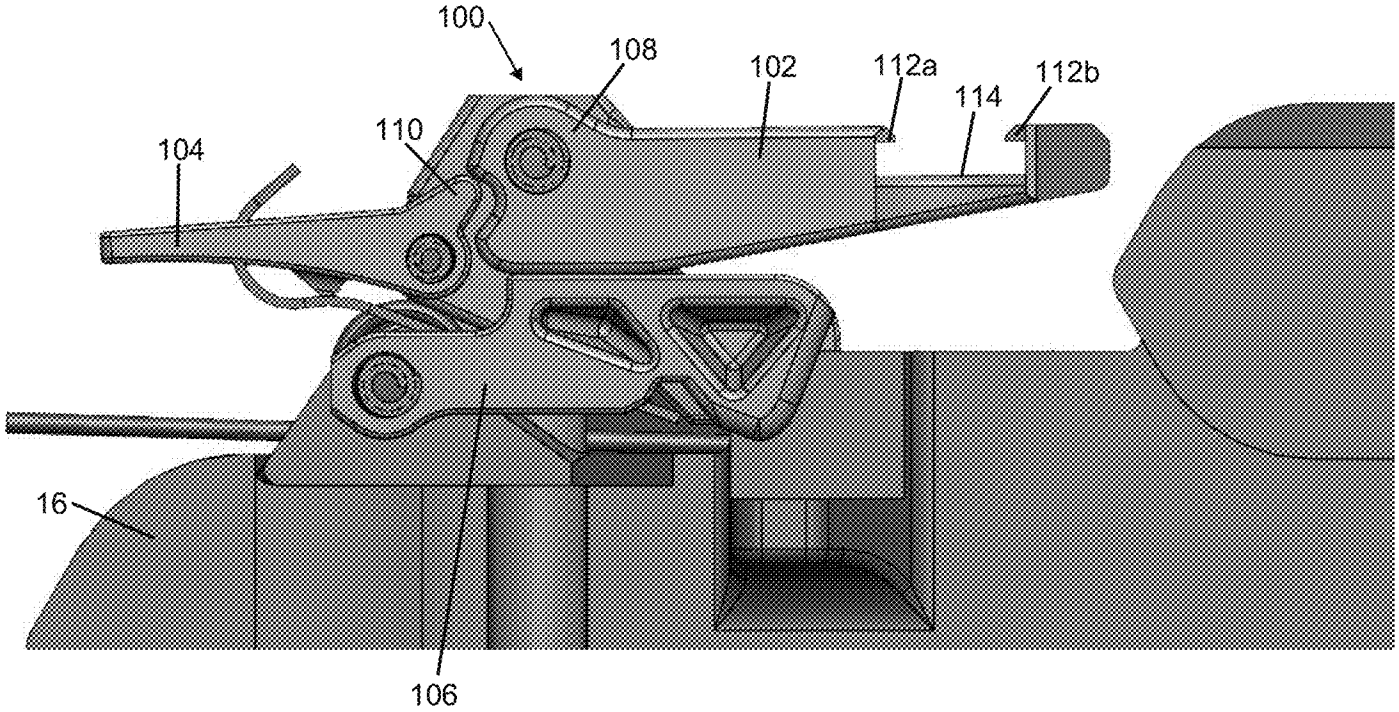
FIG. 4 is a zoomed in top view of the first embodiment of the disclosed device the latch in a closed position.
Figure 5:
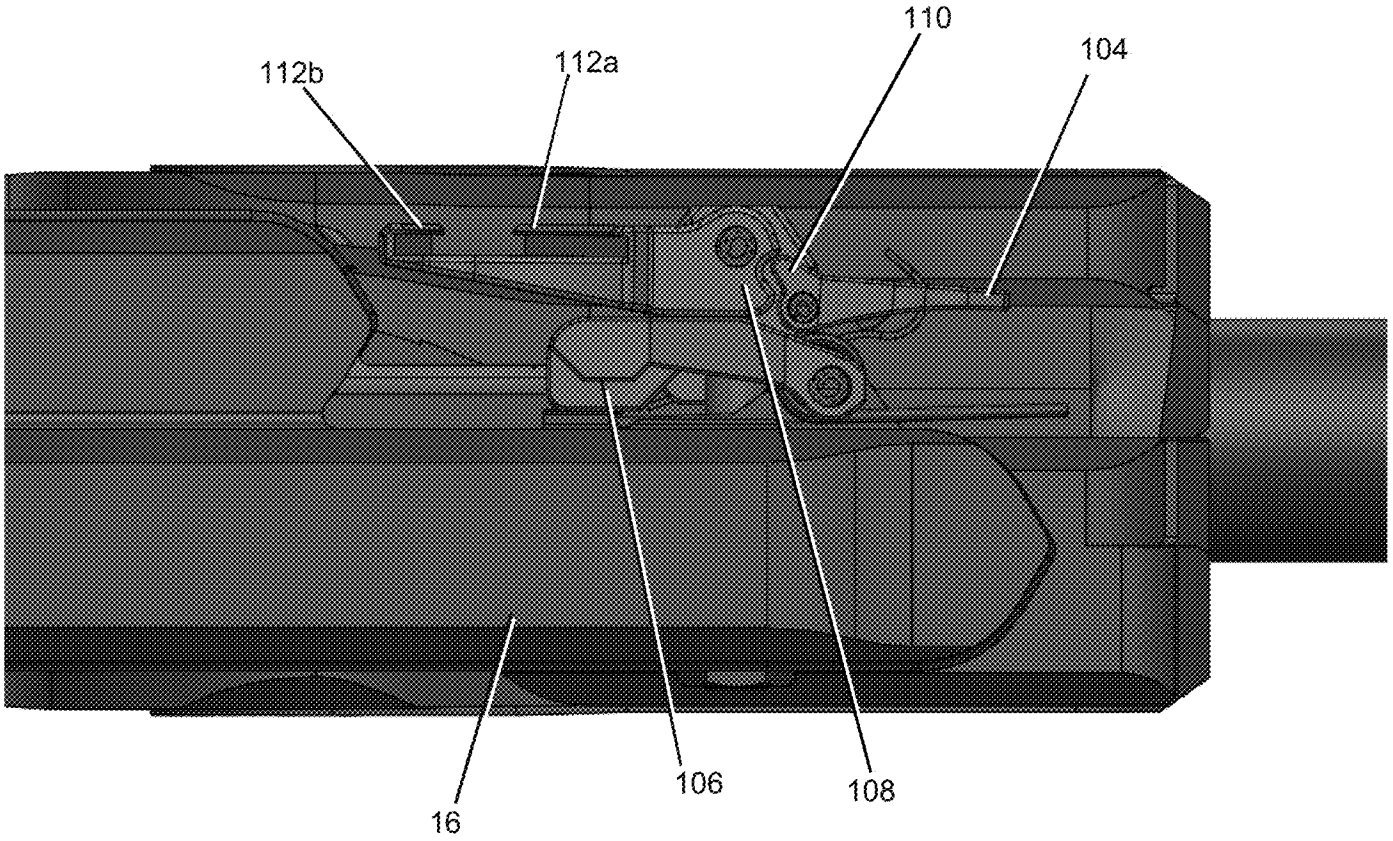
FIG. 5 is a zoomed in bottom view of the first embodiment of the disclosed device the latch in a closed position.
Figure 6:
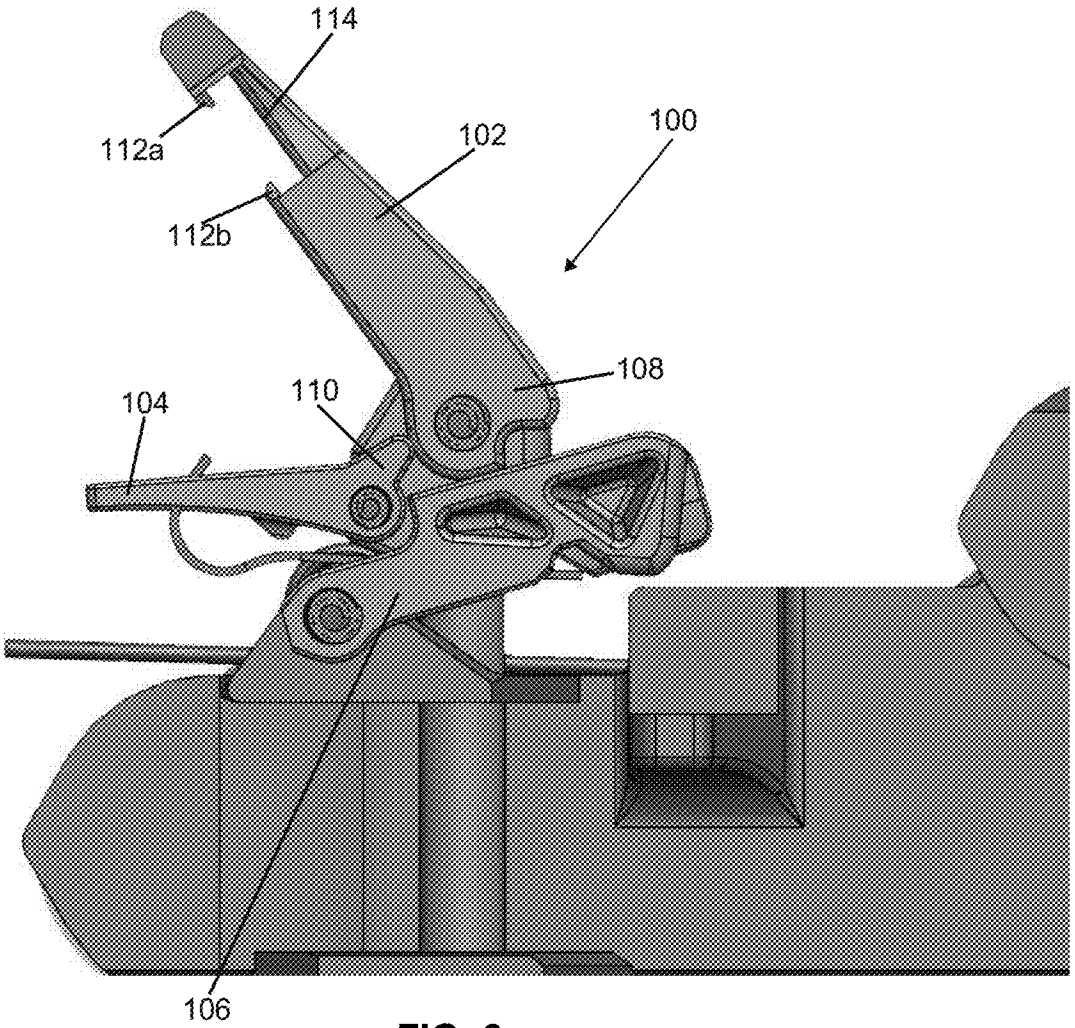
FIG. 6 is a zoomed in top view of the first embodiment of the disclosed device with the latch in an open position.
Figure 7:
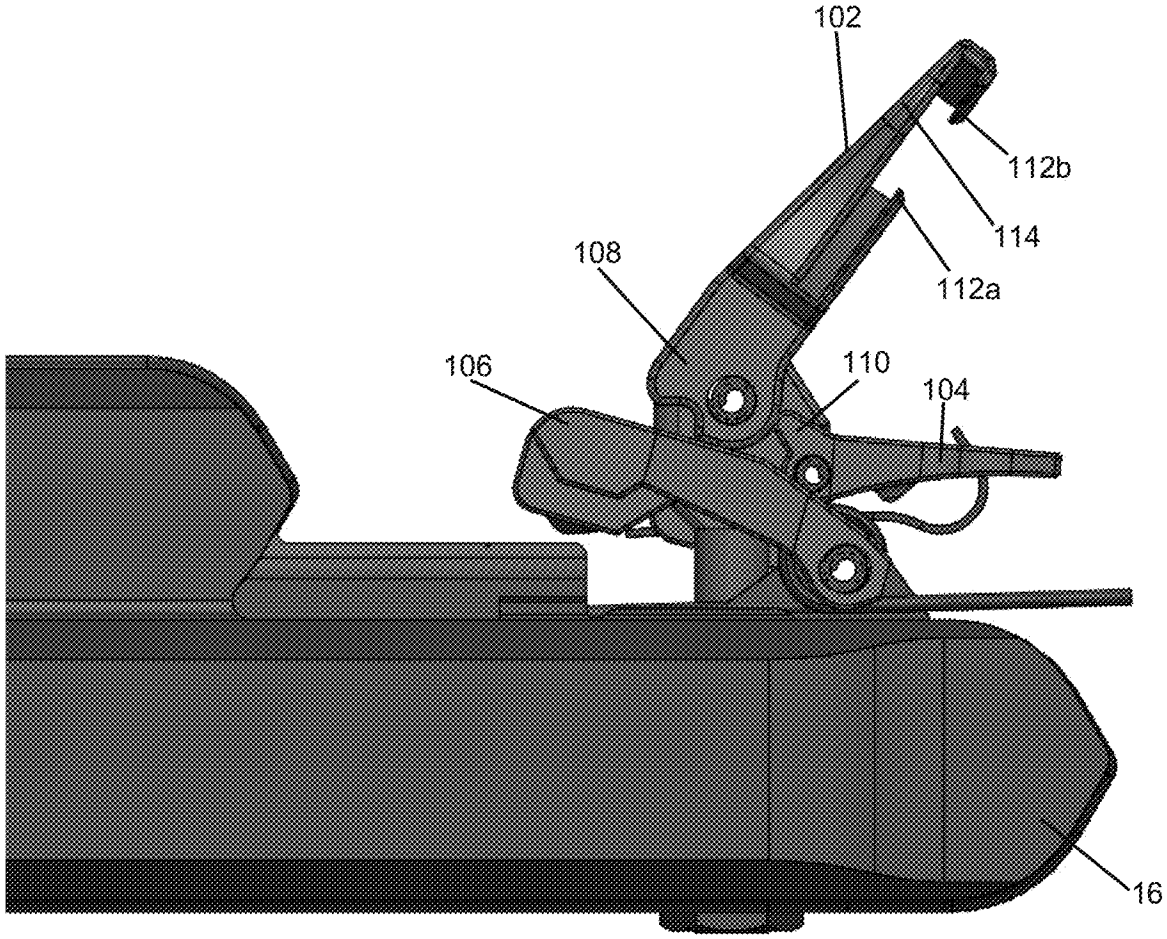
FIG. 7 is a zoomed in bottom view of the first embodiment of the disclosed device with the latch in an open position.
Figure 8:
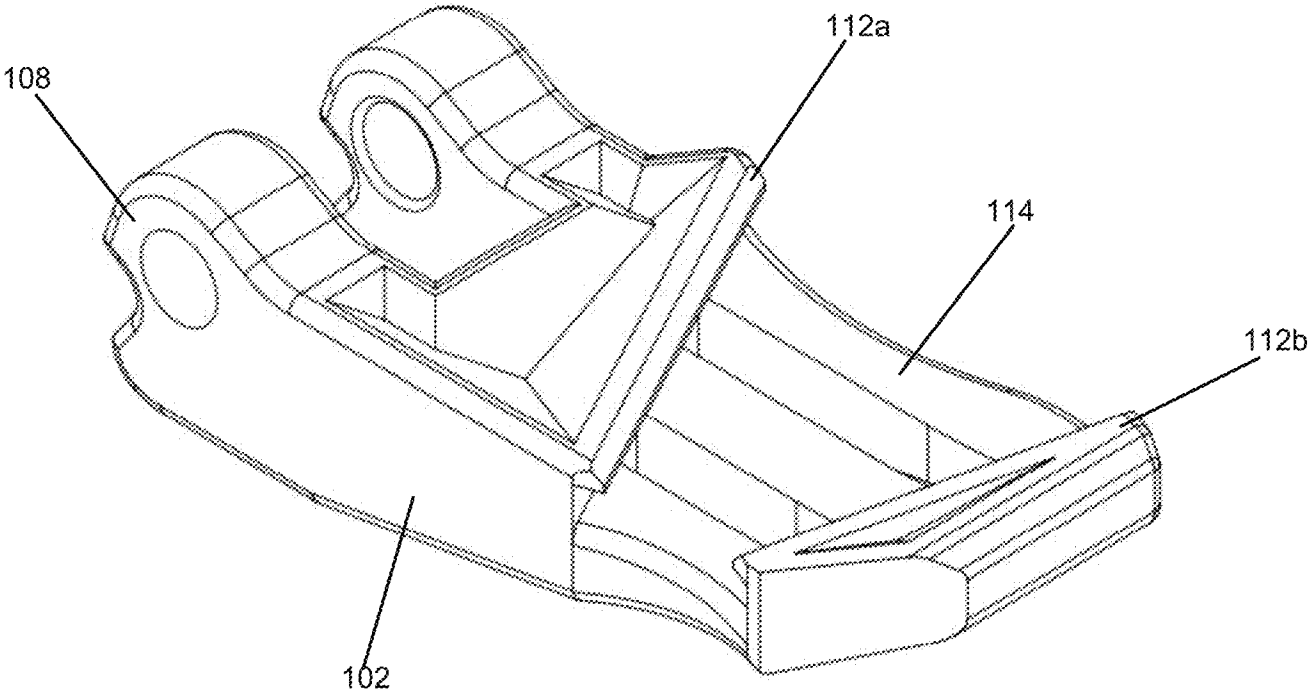
FIG. 8 is a perspective view of a primary lever of the disclosed device.
Figure 9:
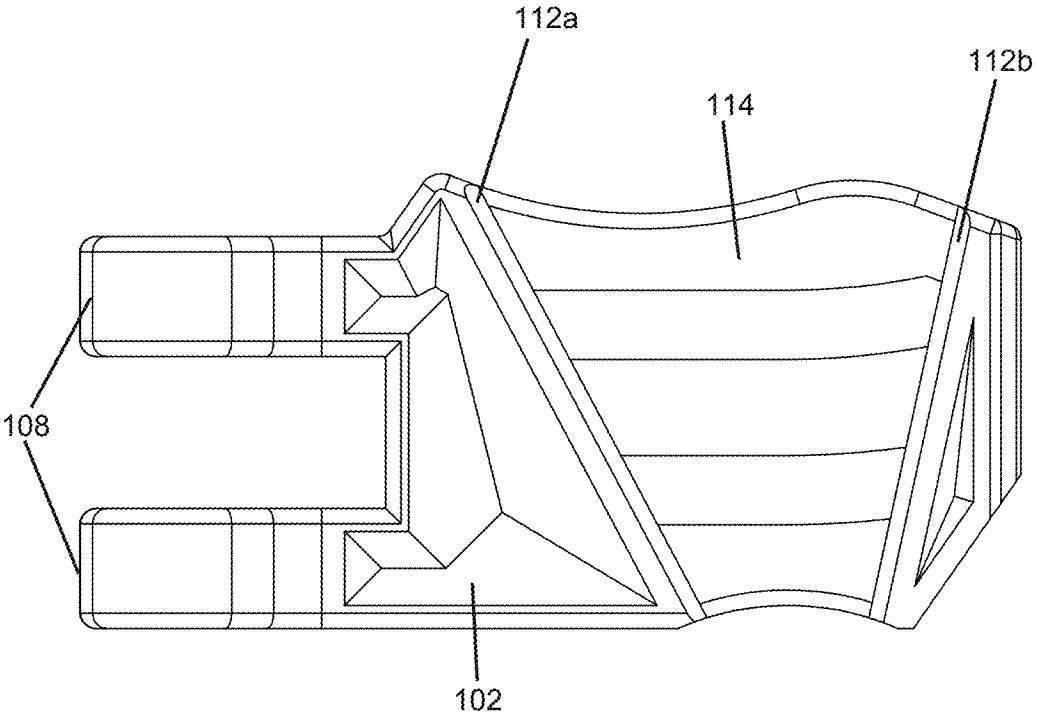
FIG. 9 is a side view of the primary lever of the disclosed device.
Figure 10:
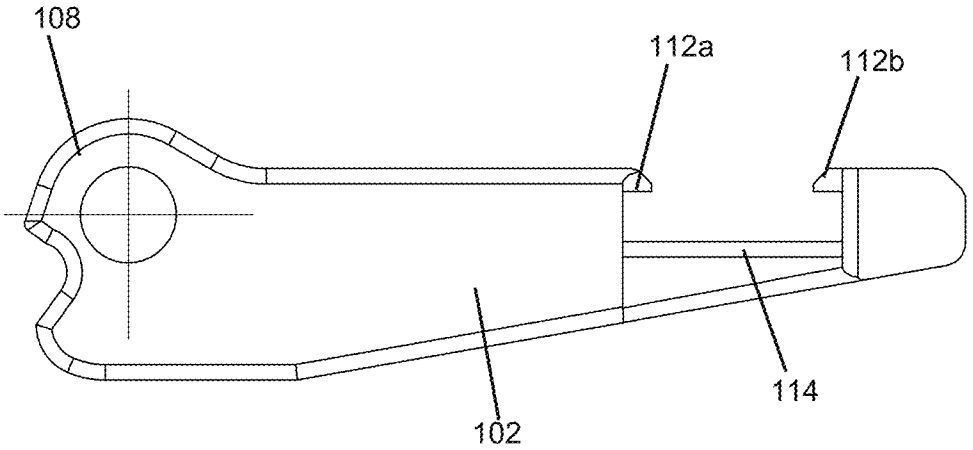
FIG. 10 is a bottom view of the primary lever of the disclosed device.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

It must be noted that, as used in this specification and the appended claims, the singular forms "a," "an," and "the" include plural referents unless the context clearly dictates otherwise.

In describing and claiming the present disclosure, the following terminology will be used in accordance with the definitions set out below.

As used herein, the terms "comprising," "including," "containing," "characterized by," and grammatical equivalents thereof are inclusive or open-ended terms that do not exclude additional, unrecited elements or method steps.

Applicant has developed a attachment system designed and configured to attached and secure a secondary weapon suppression device to a primary weapon suppression device. The disclosed attachment system may include a cam and lever system that may be utilized to lock the latching mechanism into position, and to release or unlock the latching mechanism.

Referring not to FIGS. 1-11, a first embodiment of the disclosed secondary suppressor attachment system includes, a weapon 10, such as a gun or rifle, or any desired energy generating and expelling device. A primary energy suppression device 14 may also be scalable in size to account for any desired caliber of weapon 10. The weapon 10 may include a barrel 12, where the weapon 10 may be designed and configured to generate enough energy to expel a bullet through the barrel 12.

The primary suppression device 14, or primary device, may be permanently fixed to the barrel 12 of the weapon 10, or may be removably attached to the weapon 10 via threaded engagement, or any other desire engagement mechanism. The primary device 14 may include an outer housing that may be designed and configured to engage with or, attach to, a secondary suppression device 16, or secondary device.

The secondary device 16, may be attached to the primary device 14. The secondary device 16 may utilize many of the technological features of the primary device 16 and can therefore, even further regulate the release of energy expelled from the weapon 10. The secondary device 16 may also be scalable in size to account for any desired caliber of weapon 10.

The secondary device 16 may include an attachment mechanism 100, or latch mechanism. The attachment mechanism 100 may include a first lever 102, a second lever 104 and a third lever 106.

The first lever 102 of the attachment mechanism 100 may include a cam 108 which may rotate about a pivot point when moving from an open or unlocked position, to a closed or locked position.

The attachment mechanism 100 may be moved to a locked position when the first lever 102 is pushed toward or in the direction of the third lever 100. As the first lever 102 moves into a locked position, the first lever 102 may push against the third lever 106. The third lever 106 is subsequently biased against both the primary device 14 and the secondary device 16, such that the secondary device 16 may not be disengaged from the primary device 14 while the attachment mechanism 100 is in the locked position.

In the locked position, a bottom surface of the first lever 100 may be in substantially flush against a top surface of the third lever 106. Once the attachment mechanism 100 is in the locked position, the second lever 104 may be pushed or biased (by a spring) away from the secondary device 16 or pushed toward the first lever 102.

As the second lever 104 is pushed or biased toward the first lever 102, the second lever 104 may rotate around a pivot point such that a cam 110 of the second lever 104 may also rotate and engage with a recess adjacent to the cam 108 of the first lever 102, preventing the first lever 102 from rotating or being pulled into the open position. Thus, the second lever 104 may act as a safety locking feature, preventing the attachment mechanism 100 from unintentionally unlocking or releasing the attachment mechanism 100, and thereby unintentionally releasing the secondary device 16 from the primary device 14.

In order to unlock or release the attachment mechanism 100 the second lever 104 must first be pushed or rotated away from the first lever 102. As the second lever is pushed away from the first lever 102 the cam 110 of the second lever may also rotate away from the first lever 102, and more specifically, disengage with the recess adjacent to the cam 108 of the first lever 102, thus allowing the first lever 102 to be pulled away from the secondary device 16 and/or the third lever 106, allowing the attachment mechanism 100 to be moved into an open or unlocked position.

Due to high compressive forces between the first lever 102 and the third lever 106 when the first lever 102 is rotated into the locking position against the third lever 106, it may be very difficult for a user to pull or disengage the first lever 102 from the locked position to the open or unlocked position. It may also be difficult to pull or disengage the first lever 102 from the locked position to the open or unlocked position due to the relatively short moment arm of the first lever 102 to the pivot point of the first lever 102 and due to the minimal clearance between the first lever 102 and the secondary device 16 itself, making it quite difficult, if not impossible for a user to wedge or position a finger between the first lever 102 and the secondary device 16 in order to generate enough force to pull the first lever 102 into the open position.

In order to provide more leverage to a user in opening the attachment mechanism 100, the first lever 102 may be designed and configured to include a slot 114. The slot 114 may have a width that may tapper from a first terminating end to a second terminating end. The slot 114 may also include a pair of rails 112*a* and 112*b*.

The rails 112*a* and 112*b* may be designed and configured to overhang the slot 114. The rails 112*a* and 112*b* may also be positioned such that they run along otter opposing sides of the slot from the first terminating end to the second terminating end of the slot 114. Due to the tapering width of the slot 114, the rails 112*a* and 112*b* may also be configured and positioned in a converging orientations with one another, such that the rails 112*a* and 112*b* may be further apart at the first terminating end of the slot 114 and closer together at the second terminating end of the slot 114.

Figure 11:
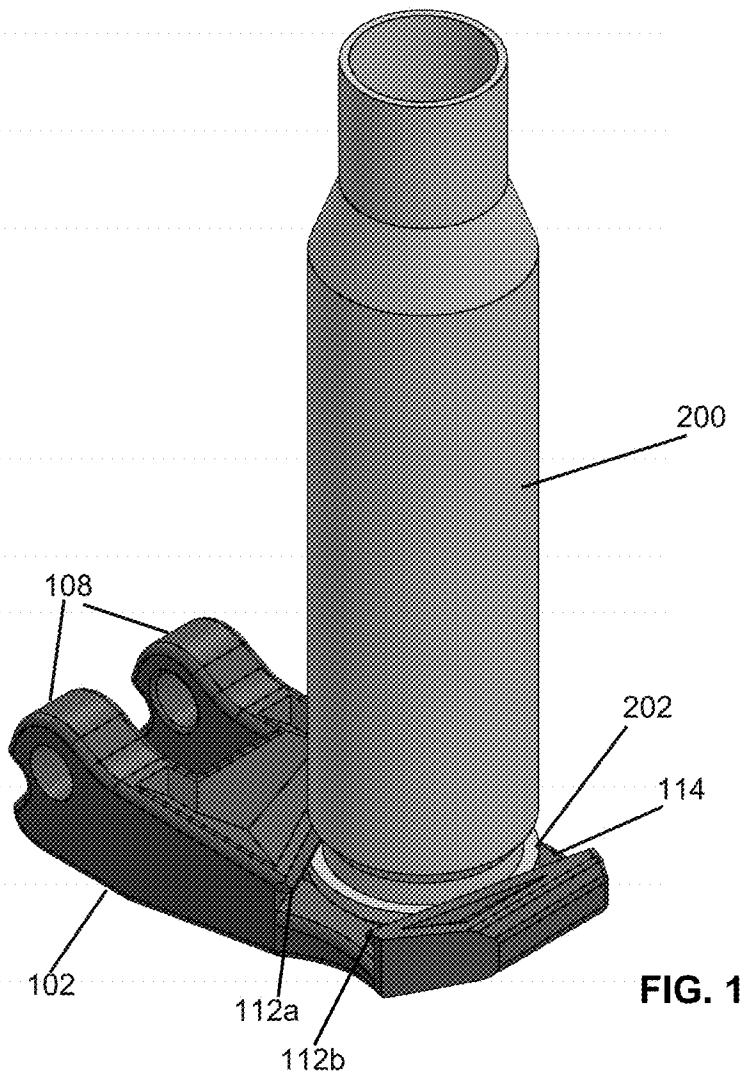
FIG. 11 is a perspective view of the primary lever of the disclosed device engaged with an ammunition casing.

Referring specifically to FIG. 11, the slot 114 and corresponding rails 112*a* and 112*b* may be designed and configured to receive a casing 200, or cartridge, of an ammunition, or a tool. More specifically, the slot 114 and corresponding rails 112*a* and 112*b* may be designed and configured to receive a rim 202 of the casing 200.

The rim 202 of the casing may have a greater diameter that a portion of the casing 200 immediately adjacent to the rim 202. Accordingly the rim 202 may be slid into the slot 114 such that the rim 202 may be positioned between the rails 112*a* and 112*b* and a bottom surface of the slot 114.

The casing 200 may be inserted into the slot 114 at a first terminating end of the slot 114 and slid toward the second terminating end of the slot 114 unto the casing 200 contacts both rails 112*a* and 112*b* simultaneously or concurrently, with the rim 202 positioned between the rails 112*a* and 112*b* and a bottom surface of the slot 114.

Once the casing 200 contacts both rails 112*a* and 112*b* simultaneously or concurrently, the casing 200 can be used by a user to apply a pulling force on the first lever 102 into the open position. This may be accomplished because an end of the casing 200 furthest away from the first lever 102 may create an extended force moment arm with respect to the pivot point of the first lever 102, that the force moment arm created by an end of the first lever 102.

Accordingly, user may use the casing 200 to apply a greater force on the first lever to move the first lever 102 to the open or unlocked position.

Another advantage of the disclosed slot 114 and rail 112*a* and 112*b* configuration and design is the tapered width of the slot 114. The tapered width of the slot 114 allows casings 200 of various diameters and calibers to be used interchangeably with the slot 114 to move the first lever into an open position.

Another advantage of the disclosed slot 114 and rail 112*a* and 112*b* configuration is that a user of the weapon 10 may likely always or nearly always have an ammunition casing 200 available to use because the weapon requires ammunition with casings 200 in order to function in its intended purpose. Essentially, designing the slot to accommodate casings 200 of various sizes and calibers nearly ensures that a user may always or nearly always have a "tool" to aid in moving the first lever from the closed or locked position to the open or unlocked position. This disclosed slot 114 configuration obviates the need for a unique or particular tool, in addition to ammunition casings 200, to aid in moving the first lever from the closed or locked position to the open or unlocked position.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as future included claims may reflect, inventive aspects lie in less than all features of a single foregoing disclosed embodiment.

It is to be understood that the above-described arrangements are only illustrative of the application of the principles of the present disclosure. Numerous modifications and alternative arrangements may be devised by those skilled in the art without departing from the spirit and scope of the present disclosure. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

ADDITIONAL SPECIFICATION SUPPORT

Embodiment 1. An attachment system for a energy suppression device comprising:

an energy suppression device;

an attachment mechanism secured to the energy suppression device;

the attachment device including:

a first lever and a second lever, wherein the first lever is rotatable with respect to the second lever such that the first lever applies a force against the second lever when in a locked position and the force is reduced when the first lever is moved to an unlocked position;

the first lever having a slot having a width that tappers from a first end of the slot to a second end of the slot; and wherein the slot is configured to receive a tool to apply additional force to move the first lever from the locked position to the unlocked position.

Embodiment 2. The system of embodiment 1, wherein the first lever includes a pair of rails that overhang the slot.

Embodiment 3. The system of embodiment 2, wherein the pair of rails are positioned in a converging orientation.

Embodiment 4. The system of embodiment 1, wherein the tool is an ammunition casing.

Embodiment 5. The system of embodiment 1, wherein the slot and the pair of rails are configured to receive a rim of the ammunition casing.

Embodiment 6. The system of embodiment 1, wherein the energy suppression device is configured to be attached to a weapon.

Embodiment 7. An attachment mechanism for a energy suppression device comprising:

an energy suppression device;

an attachment mechanism secured to the energy suppression device;

the attachment device including:

a first lever, wherein the first lever is rotatable with respect to the energy suppression device such that the first lever applies a force against the energy suppression device when in a locked position and the force is reduced when the first lever is moved to an unlocked position;

the first lever having a slot having a width that tappers from a first end of the slot to a second end of the slot; and wherein the slot is configured to receive an ammunition casing to apply additional force to move the first lever from the locked position to the unlocked position.

Embodiment 8. The system of embodiment 7, wherein the attachment mechanism further includes:

a second lever, wherein the first lever is rotatable with respect to the second lever such that the first lever applies a force against the second lever when in a locked position and the force is reduced when the first lever is moved to an unlocked position.

Embodiment 9. The system of embodiment 7, wherein the first lever includes a pair of rails that overhang the slot.

Embodiment 10. The system of embodiment 9, wherein the pair of rails are positioned in a converging orientation.

Embodiment 11. The system of embodiment 10, wherein the slot and the pair of rails are configured to receive a rim of the ammunition casing.

Embodiment 12. The system of embodiment 7, wherein the energy suppression device is configured to be attached to a weapon.

What is claimed:

1. An attachment system for a energy suppression device comprising: an energy suppression device; an attachment mechanism secured to the energy suppression device; the attachment mechanism including: a first lever and a second lever, wherein the first lever is rotatable with respect to the second lever such that the first lever applies a force against the second lever when in a locked position and the force is reduced when the first lever is moved to an unlocked position; the first lever having a slot having a width that tappers from a first end of the slot to a second end of the slot; and wherein the slot is configured to receive a tool to apply additional force to move the first lever from the locked position to the unlocked position.

2. The system of claim 1, wherein the first lever includes a pair of rails that overhang the slot.

3. The system of claim 2, wherein the pair of rails are positioned in a converging orientation.

4. The system of claim 1, wherein the tool is an ammunition casing.

5. The system of claim 1, wherein the slot and the pair of rails are configured to receive a rim of the ammunition casing.

6. The system of claim 1, wherein the energy suppression device is configured to be attached to a weapon.

7. An attachment mechanism for a energy suppression device comprising: an energy suppression device; an attachment mechanism secured to the energy suppression device; the attachment mechanism including: a first lever, wherein the first lever is rotatable with respect to the energy suppression device such that the first lever applies a force against the energy suppression device when in a locked position and the force is reduced when the first lever is moved to an unlocked position; the first lever having a slot having a width that tappers from a first end of the slot to a second end of the slot; and wherein the slot is configured to receive an ammunition casing to apply additional force to move the first lever from the locked position to the unlocked position.

8. The system of claim 7, wherein the attachment mechanism further includes:

a second lever, wherein the first lever is rotatable with respect to the second lever such that the first lever applies a force against the second lever when in a locked position and the force is reduced when the first lever is moved to an unlocked position.

9. The system of claim 7, wherein the first lever includes a pair of rails that overhang the slot.

10. The system of claim 9, wherein the pair of rails are positioned in a converging orientation.

11. The system of claim 10, wherein the slot and the pair of rails are configured to receive a rim of the ammunition casing.

12. The system of claim 7, wherein the energy suppression device is configured to be attached to a weapon.

* * * * *